US010212991B2

(12) United States Patent
Takazawa et al.

(10) Patent No.: US 10,212,991 B2
(45) Date of Patent: Feb. 26, 2019

(54) FASTENER CHAIN ELEMENT AND FASTENER CHAIN

(71) Applicant: YKK Corporation, Tokyo (JP)

(72) Inventors: Shigeyoshi Takazawa, Toyama (JP); Shigeki Annaka, Taipei (TW); Naoyuki Himi, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/316,321

(22) PCT Filed: Jun. 5, 2014

(86) PCT No.: PCT/JP2014/064917
§ 371 (c)(1),
(2) Date: Dec. 5, 2016

(87) PCT Pub. No.: WO2015/186217
PCT Pub. Date: Dec. 10, 2015

(65) Prior Publication Data
US 2017/0135445 A1 May 18, 2017

(51) Int. Cl.
*A44B 19/06* (2006.01)

(52) U.S. Cl.
CPC ..... *A44B 19/06* (2013.01); *Y10T 24/2548* (2015.01); *Y10T 24/2555* (2015.01)

(58) Field of Classification Search
CPC ..... Y10T 24/2548; Y10T 24/2539; Y10T 24/2543; Y10T 24/2552; Y10T 24/2554; Y10T 24/2555; A44B 19/04; A44B 19/06; A44B 19/02; A44B 19/24
See application file for complete search history.

(56) References Cited

U.S. PATENT DOCUMENTS

| | | | | |
|---|---|---|---|---|
| 2,385,020 | A * | 9/1945 | Morin | A44B 19/04 24/410 |
| 2,385,021 | A * | 9/1945 | Morin | A44B 19/04 24/410 |
| 9,215,912 | B2 * | 12/2015 | Kondo | A44B 19/04 |
| 9,220,324 | B1 | 12/2015 | Nunn | |
| 2006/0130292 | A1 | 6/2006 | Kondo et al. | |
| 2016/0227887 | A1 * | 8/2016 | Kojima | A44L 319/36 |

FOREIGN PATENT DOCUMENTS

| | | | |
|---|---|---|---|
| JP | 47-037061 | B1 | 9/1972 |
| JP | 2006-149707 | A | 6/2006 |
| JP | 2006-167191 | A | 6/2006 |

OTHER PUBLICATIONS

International Search Report, PCT International Patent Application No. PCT/JP2014/064917, dated Aug. 19, 2014.
Written Opinion of the International Searching Authority issued for PCT/JP2014/064917.

* cited by examiner

*Primary Examiner* — Robert Sandy
*Assistant Examiner* — Michael S Lee
(74) *Attorney, Agent, or Firm* — Kilpatrick Townsend & Stockton LLP

(57) ABSTRACT

There is provided an element for a fastener chain. The element includes a body portion fixed on a core portion of a tape, a neck portion, a pair of shoulder portions, an engaging head portion, and a pair of groove portions. As viewed in the width direction, at least one of the pair of shoulder portions and the pair of groove portions is configured to be inclined with respect to a reference direction, which is an extending direction of the core portion on which the body portion is fixed.

11 Claims, 9 Drawing Sheets

FASTENER CHAIN ELEMENT AND FASTENER CHAIN

This application is a national stage application of PCT/JP2014/064917, which is incorporated herein by reference.

TECHNICAL FIELD

The present invention relates to an element for a fastener chain and a fastener chain employing a plurality of the elements.

BACKGROUND ART

As fastener chains, a fastener chain is known, which includes a pair of rectangular tapes having a length direction and a width direction and a pair of element rows fixed on core portions extending along opposing side edge portions of the pair of tapes, in which each element rows is constituted of a plurality of elements.

As conventional examples of elements, an element is known, which includes a body portion fixed on the core portion of the tape, a neck portion protruding from the body portion toward the opposing tape, a pair of shoulder portions protruding from the neck portion toward both sides in the length direction, an engaging head portion protruding from the neck portion toward the opposing tape, and a pair of groove portions formed in both sides, in the length direction, of the engaging head portion and communicated with each other in the length direction (see Patent Document 1).

As viewed in the width direction, the pair of groove portions and the pair of shoulder portions are formed to be parallel to an extending direction of the core portion on which the element itself is fixed. Accordingly, in a case where a fastener chain is made using a plurality of such elements, if no external force is exerted on the closed fastener chain, the core portion extends in a straight line shape, and the fastener chain extends in a straight line shape to be parallel to an extending direction of the core portion as viewed in the width direction.

PRIOR ART DOCUMENT

Patent Document

Patent Document 1: Japanese Patent Application Publication No. 2006-149707A

SUMMARY OF INVENTION

Problems to be Solved by Invention

By the way, if the elements are engaged with each other, a gap is formed between the shoulder portion and the groove portion, which are engaged with each other, and the fastener chain can be curved by an extend corresponding to the gap. However, even if the gap exists, the fastener chain when the elements are engaged with each other is kept parallel to the extending direction of the core portion as viewed in the width direction, if no external force is exerted on the fastener chain. The element is just one in which a curved shape of the fastener chain can be passively formed.

However, if there is a fastener chain which can actively form such a curved shape, it can be said that a slide fastener employing the fastener chain is preferable to be attached to and used with an object having a curved portion.

The present invention has been made keeping in mind the above problems, and an object thereof to provide an element and a fastener chain employing the element suitable to actively form a curve shape.

Means for Solving Problems

An element for a fastener chain according to the present invention includes a body portion fixed on a core portion of a tape extending in a length direction and a width direction, the core portion extending in the length direction on one side edge portion, in the width direction, of the tape; a neck portion protruding from the body portion to extend away from the tape in the width direction; a pair of shoulder portions protruding from both surfaces, in the length direction, of the neck portion; an engaging head portion protruding from the neck portion to extend away from the tape in the width direction; and a pair of groove portions formed in both surfaces, in the length direction, of the engaging head portion. Also, the element for the fastener chain of the present invention is characterized in that as viewed in the width direction, at least one of the pair of shoulder portions and the pair of groove portions is configured to be inclined with respect to a reference direction, which is an extending direction of the core portion on which the body portion is fixed.

Herein, the phrase "as viewed in the width direction, at least one of the pair of shoulder portions and the pair of groove portions is configured to be inclined with respect to a reference direction, which is an extending direction of the core portion on which the body portion is fixed" is intended to mean that a case where all of the pair of shoulder portions and the pair of groove portions are parallel to the reference direction is excluded. Also, specified examples of the element include elements according to the following (1) to (6).

The element according to (1) is configured so that as viewed in the width direction, three or less of the pair of shoulder portions and the pair of groove portions are inclined with respect to the reference direction and the remainder is parallel to the reference direction.

The element according to (2), which is a further specified example of the element according to (1), is configured so that as viewed in the width direction, the pair of groove portions are parallel to the reference direction and the pair of shoulder portions are inclined with respect to the reference direction.

The element according to (3), which is a further specified example of the element according to (2), is configured so that as viewed in the width direction, a parallel groove width dimension W1, as measured in a direction perpendicular to the reference direction, of dimensions of each of the groove portions which are parallel to the reference direction, an inclined shoulder-portion thickness dimension T1, as measured in a direction perpendicular to an inclining direction, of dimensions of each of the shoulder portions which are inclined, and an inclined shoulder-portion height dimension H1, as measured in a direction perpendicular to the reference direction, of dimensions of each of the shoulder portions satisfy the following relationship: H1>W1>T1.

The element according to (4), which is a further specified example of the element according to (2) or (3), is configured so that as viewed in the width direction, the pair of shoulder portions are inclined to be symmetrical with respect to the neck portion as a symmetry axis.

The element according to (5), which is a further specified example of the element according to (1), is configured so that as viewed in the width direction, the pair of shoulder portions are parallel to the reference direction and the pair of groove portions are inclined with respect to the reference direction.

The element according to (6), which is a further specified example of the element according to (5), is configured so that as viewed in the width direction, a inclined groove width dimension W2, as measured in a direction perpendicular to an inclining direction, of dimensions of each of the groove portions which are inclined, a parallel shoulder-portion thickness dimension T2, as measured in a direction perpendicular to the reference direction, of dimensions of each of the shoulder portions which are parallel to the reference direction, and a second parallel shoulder-portion thickness dimension H2, as measured in a direction perpendicular to the inclining direction of each of the groove portions, of dimensions of each of the shoulder portions satisfy the following relationship: H2>W2>T2.

Further, a fastener chain according to the present invention includes a pair of tapes extending parallel to each other in a length direction and arranged to oppose each other in a width direction, and a pair of element rows fixed on core portions of the pair of tapes, in which the core portions are, respectively, opposing side edge portions of the pair of tapes. Also, the fastener chain of the present invention is characterized in that the pair of element rows includes a plurality of elements fixed on each of the tapes along the length direction, in which the element of the present invention is employed for at least two elements, which are arranged to be engaged with each other, of the plurality of elements.

According to a specified example of the fastener chain of the present invention, each of the element rows includes first elements and second elements, each of the first elements is the element described above and the second elements are different from the first elements, in which each of the second elements includes a body portion, a neck portion, a pair of shoulder portions and a pair of groove portions, and also is configured so that as viewed in the width direction, the pair of shoulder portion and the pair of groove portions thereof are parallel to a reference direction, which is an extending direction of the core portion on which the body portion is fixed.

Advantageous Effects of Invention

According to the element of the present invention, as viewed in the width direction, at least one of the pair of shoulder portions and the pair of groove portions is inclined with respect to the extending direction of the core portion on which the body portion is fixed. Therefore, if a fastener chain employs the element of the present invention, the fastener chain can actively form a curved shape when being closed.

EMBODIMENTS OF INVENTION

Figure 1:
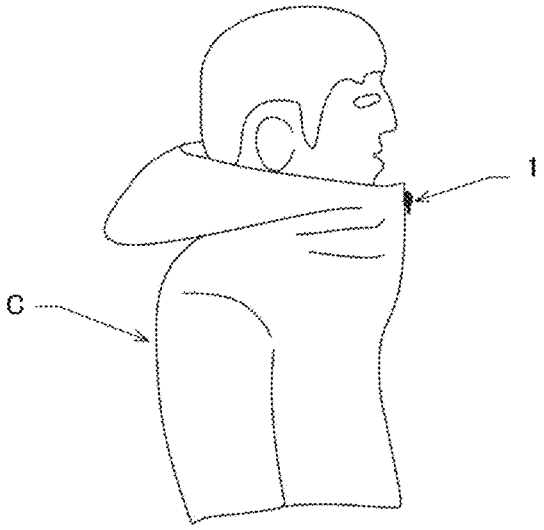
FIG. 1 is a side view showing clothes employing a fastener chain of the present invention.

The present invention relates to an element for a fastener chain and a fastener chain employing a plurality of the elements, and a slide fastener employing the fastener chain is attached to and used with an object, such as bags and clothes. In FIG. 1, a suit of clothes C as an example of the object to which a slide fastener 1 is attached is shown. The clothes C has the slide fastener 1 fixed along an upward and downward direction on a middle portion, in a width direction, of a front surface of a body thereof. Also, the body of the clothes C has portions corresponding to a chin, a neck and a chest of a human body (hereinafter, respectively referred to as "chin portion," "neck portion," and "chest portion"). Further, the body is configured so that the chin portion protrudes more forward than the chest portion and the neck portion connecting between the chest portion and the chin portion has a curved shape. For such an object, which has a curved shape as in the neck portion, the slide fastener 1 employing the fastener chain (element) of the present invention is used.

Figure 2:
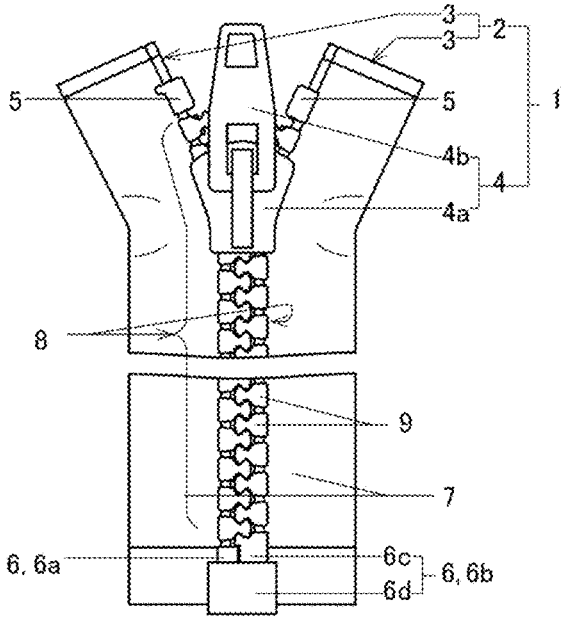
FIG. 2 is a plan view showing a basic configuration of a slide fastener.

As shown in FIG. 2, an example of the slide fastener 1 includes a fastener chain 2 extending in a front and rear direction and configured to be openable and closable at a width middle portion thereof in a right and left direction, and a slider 4 configured to be movable in the front and rear direction on the width middle portion, in the right and left direction, of the fastener chain 2. Also, the fastener chain 2 can be opened and closed by moving the slider 4 in the front and rear direction.

In the following references to directions, a front side refers to an upper side in FIG. 2 and means a direction along which the slider 4 is moved to close the fastener chain 2, and a rear side refers to a lower side in FIG. 2 and means a direction along which the slider 4 is moved to open the fastener chain 2. Also, one direction of directions perpendicular to the front and rear direction is a right and left direction and also a width direction of the fastener chain 2. Meanwhile, on the basis of a shape of the fastener chain 2, the front and rear direction may be referred to as a length direction and the right and left direction may be referred to as the width direction. In addition, the fastener chain 2 has a pair of fastener stringers 3, 3 extending in the front and rear direction and arranged adjacent to each other so that one side edge portion of each thereof opposes each other. Thus, the right and left direction is also a direction along which the pair of fastener stringers 3, 3 are arranged. Also, a direction perpendicular to the front and rear direction and also to the right and left direction is referred to as an upward and downward direction. Further, a left side refers to a left side in FIG. 2 and a right side refers to a right side in FIG. 2. An upper side refers to a front side in a direction perpendicular to a paper surface of FIG. 2, i.e., a direction perpendicular to the front and rear direction and the right and left direction, and a lower side refers to a back side in the direction perpendicular to the paper surface of FIG. 2.

As described above, the fastener chain 2 is constituted of a pair of fastener stringers 3, 3, and the slider 4 is configured to be movable in the front and rear direction along opposing right and left side edge portions of the pair of fastener stringers 3, 3. The pair of fastener stringers 3, 3 includes a pair of tapes 7, 7 extending in the front and rear direction, which is a length direction thereof, and arranged in parallel to each other in the right and left direction, which is a width direction thereof, a pair of element rows 8, 8 fixed along opposing right and left side edge portions of the pair of tapes 7, 7, a pair of stops 5, 5 positioned adjacent to a front side of a movement range of the slider 4 and thus defining a forward movement limit position for the slider 4, and a pair of stops 6, 6 positioned adjacent to a rear side of the movement range of the slider 4 and thus defining a rearward movement limit position for the slider 4.

As shown in FIG. 2, the slider 4 includes a slide body 4*a* engaged with the pair of element rows 8, 8 and configured to be movable in the front and rear direction, and a pull tab 4*c* connected to a pull tab attachment portion 4*b* of the slider body 4*a*.

The slider body 4*a* has an element passage (not shown) formed to extend in the front and rear direction therethrough, and a pair of tape insertion passages (not shown) communicated with the element passage and, respectively, opened to right and left sides. The pair of element rows 8, 8 pass through the element passage, and each tape 7 passes through the respective tape insertion passages.

Figure 3:
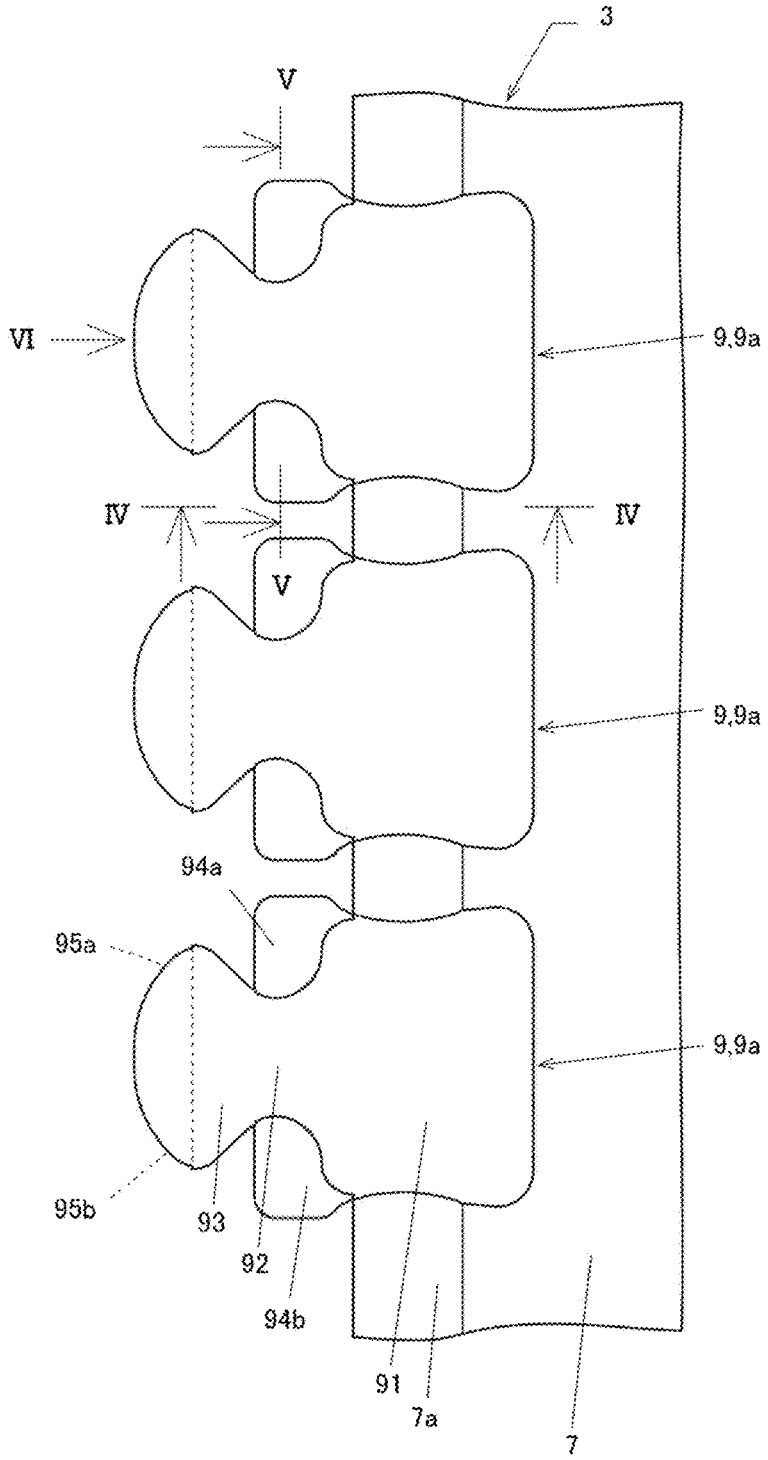
FIG. 3 is an enlarged plan view showing a part of a fastener chain according to a first embodiment of the preset invention.
Figure 4:
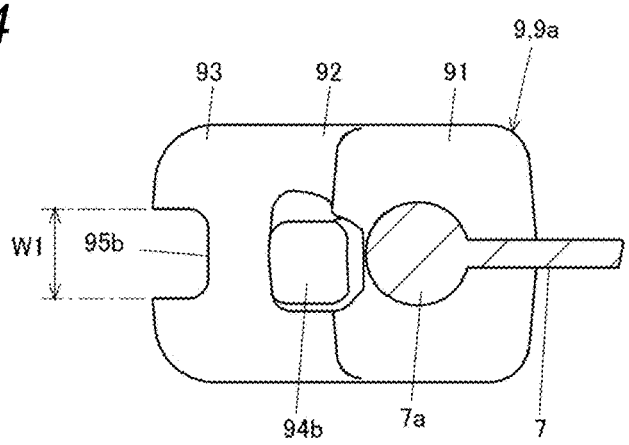
FIG. 4 is a sectional view taken along a line IV-IV in FIG. 3.

As shown in FIGS. 2 to 4, each tape 7 is a fabric having a band shape, i.e., being longer in the front and rear direction than the right and left direction, and a thickness direction thereof is the upward and downward direction. Also, the tape 7 has, on one of right and left side edge portions thereof, a core portion 7*a* having a thickness thicker than that of the other side.

As shown in FIG. 2, the stops 5 on the front side are fixed on front end portions of the respective tapes 7, more specifically at a distance in front of the respective element rows 8. Also, the stops 5 on the front sides have a thickness thicker than that of elements 9 constituting the element rows 8. Thus, if the slider 4 is moved forward to close the fastener stringers 3, 3, the elements 9 of the pair of element rows 8, 8 are engaged with each other in the inside of the slider 4 and the engaged elements 9 emerge from a rear side of the slider 4, and finally, as the slider 4 collides with the stops 5, an additional forward movement of the slider 4 is blocked.

As shown in FIG. 2, the pair of stops 6, 6 on the rear side are collectively called a separable end stop, in which one stop 6 is a separable pin 6*a* fixed on one tape 7 and the other stop 6 is a retainer 6*b* fixed on the other tape 7. The retainer 6*b* has a retainer pin 6*c* parallel to a front portion of the separable pin 6*a* and a retainer body 6*d* having a separable pin hole (not shown) formed to receive a rear portion of the separable pin 6*a*. The separable pin 6*a* and the retainer body 6*d* have a thickness thicker than that of the elements 9 constituting the element rows 8. Thus, if the slider 4 is moved rearward to open the fastener stringers 3, 3, the elements 9 of the pair of element rows 8, 8 are disengaged from each other in the inside of the slider 4 and the disengaged elements 9 emerge from a front side of the slider 4, and finally, as the slider 4 collides with the pair of stops 6 on the rear side, an additional rearward movement of the slider 4 is blocked.

As shown in FIG. 2, the element rows 8 are respectively formed by a plurality of elements 9 fixed in a row at intervals in the front and rear direction along the opposing side edge portions of the tapes 7.

Figure 5:
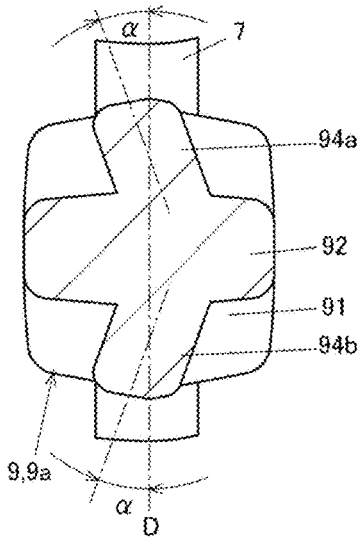
FIG. 5 is a sectional view taken along a line V-V in FIG. 3.

As shown in FIGS. 3 to 5, each element 9 is configured to protrude from one tape 7, on which the element itself is fixed, toward the other opposing tape 7 (to extend away therefrom in the width direction), and includes, as basic components thereof, a body portion 91 fixed on the core portion 7*a*, a neck portion 92 protruding from the body portion 91 toward the opposing tape 7 (to extend away from the core portion 7*a*, on which the body portion 91 itself is fixed, in the width direction), a pair of shoulder portions 94*a*, 94*b* protruding from the neck portion 92 toward both sides in the length direction and configured to be engaged with another pair of elements 9, 9, and an engaging head portion 93 protruding from the neck portion 92 toward the opposing tape 7, and a pair of groove portions 95*a*, 95*b* formed in both surfaces, in the length direction, of the engaging head portion 93 and configured to be engaged with another pair of elements 9, 9. Hereinafter, of the pair of shoulder portions 94*a*, 94*b*, a front shoulder portion which is designated by a reference numeral 94*a* is referred to as a first shoulder portion and a rear shoulder portion which is designated by a reference numeral 94*b* is referred to as a second shoulder portion. Also, of the pair of groove portions 95*a*, 95*b*, a front groove portion which is designated by a reference numeral 95*a* is referred to as a first groove portion and a rear groove portion which is designated by a reference numeral 95*b* is referred to as a second groove portion.

The body portion 91 is configured to bite the opposing side edge portion of one tape 7, on which the body portion itself is fixed, on a side facing the other tape 7 in such a manner that the side edge portion is sandwiched from upper and lower sides thereof.

The neck portion 92 and the engaging head portion 93 are configured as follows. Both ends of the neck portion 92 in the length direction are arranged to be recessed inward in the length direction relative to both ends of the body portion 91. Also, both ends of the engaging head portion 93 in the length direction are arranged to protrude outward in the length direction relative to both ends of the neck portion 92 and also are positioned inward in the length direction relative to both ends of the body portion 91. Thus, as viewed in the length direction, the element 9 is configured so that the neck portion 92 is narrower than the engaging head portion 93 and the body portion 91. Also, the neck portion 92 and the engaging head portion 93 are configured so that thicknesses thereof are generally the same as that of the body portion 91.

The first and second shoulder portions 94*a*, 94*b* and the first and second groove portions 95*a* and 95*b* are different depending on kinds of elements 9. As kinds of elements 9, a standard element 9*n* and an element 9*a* according to the present invention are present. In order to describe differences between the elements 9*n* and 9*a*, as viewed in the width direction, an extending direction of the core portion 7*a* on which the element itself (body portion 91) is fixed, more specifically an extending direction of a part, on which the body portion 91 is attached, of the core portion 7*a*, is defined as a reference direction D. By the way, the reason why the reference direction D does not simply refers to an "extending direction of the core portion 7*a*," but to the "extending direction of the core portion 7*a* on which the element itself (body portion 91) is fixed," is that when the fastener chain 2 employing the element 9*a* of the present invention is closed, the "extending direction of the core portion 7*a*" means an extending direction of the entire core portion 7*a* and thus an extending direction curved to correspond to the fastener chain 2, but the "extending direction of the core portion 7*a* on which the element itself (body portion 91) is fixed" means an extending direction of a part, on which the body portion 91 is fixed, of the core portion 7*a* and thus is always kept as an extending direction of a straight line regardless of a form of the fastener chain 2. Meanwhile, in the figures, the reference direction D is drawn at a location corresponding exactly to ½ of a thickness dimension (dimension in the upward and downward direction) of the element 9.

Figure 7:
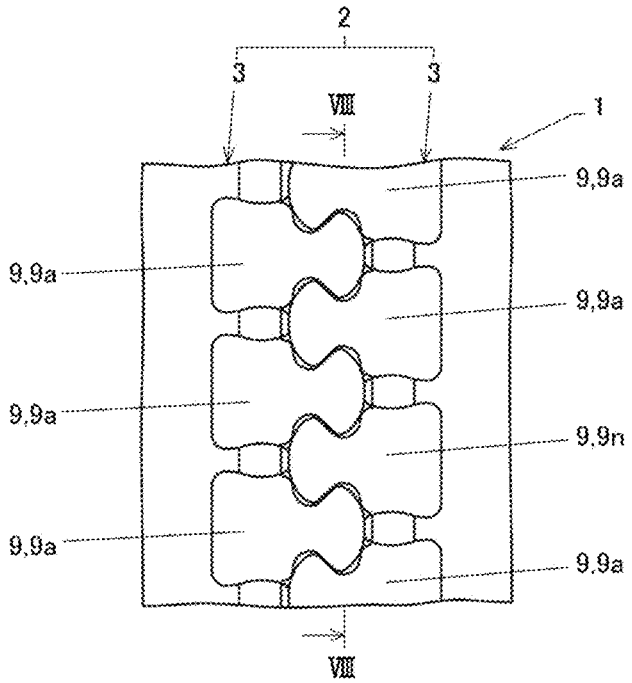
FIG. 7 is a plan view showing an engaged state of the fastener chain according to the first embodiment of the present invention.
Figure 8:
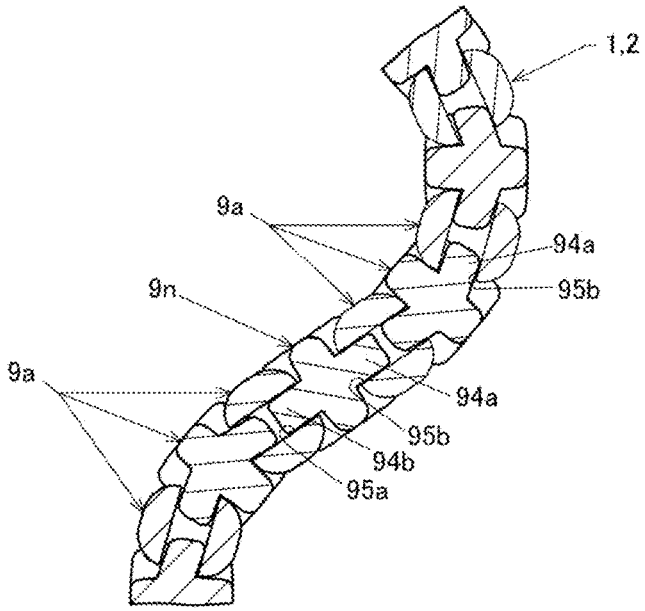
FIG. 8 is a sectional view taken along a line VIII-VIII in FIG. 7.

One example of the standard element 9*n* is the element described in the section Background Art and as shown in FIGS. 7 and 8 is configured so that as viewed in the width direction, the first and second shoulder portions 94*a*, 94*b* and the first and second groove portions (not shown in FIG. 8) are parallel to the reference direction D. By the way, in a case of a fastener chain in which the standard element 9*n* is employed as all elements 9 constituting a pair of element rows 8, 8, if no external force is exerted thereon, reference directions D of all elements 9*n* are present on the same plane, a surface defined in the length direction and width direction of tapes 7 become a flat plane, and thus the elements 9*n* are engaged with each other to be parallel to the flat plane. Therefore, hereinafter, the standard element 9*n* is also referred to as a parallel engagement element. Also, when parallel engagement elements 9*n*, 9*n* are engaged with each other, the first shoulder portion 94*a* and the first groove portion 95*a* of the element 9*n* on the rear side are respectively engaged with the second groove portion 95*b* and the second shoulder portion 94*b* of the element 9*n* on the front side. A clearance (gap) for allowing smooth engagement and disengagement is formed between the shoulder portion and the groove portion (between the first shoulder portion 94*a* and the second groove portion 95*b* and between the first groove portion 95*a* and the second shoulder portion 94*b*), which are mated with each other when engaging is performed as described above. In order to form such a clearance, for example, the first shoulder portion 94*a* is formed to have a thickness dimension (dimension in the upward and downward direction) longer than a groove width dimension (dimension in the upward and downward direction) of the second groove portion 95*b*, and the second shoulder portion 94*b* is formed to have a thickness dimension shorter than that of the first groove portion 95*a*. Meanwhile, the parallel engagement element 9*n* is formed in an upper and lower symmetric shape.

In addition, as shown in FIGS. 3 to 5, the element 9*a* according to a first embodiment of the present invention is configured so that as viewed in the width direction, the first and second shoulder portions 94*a*, 94*b* are symmetric with respect to the neck portion 92 as a symmetry axis, the first and second shoulder portions 94*a*, 94*b* are inclined with respect to the reference direction D and also the first and second groove portions 95*a*, 95*b* are parallel to the reference direction D. Because the element 9*a* of the first embodiment is configured so that as viewed in the width direction, the first and second shoulder portions 94*a*, 94*b* are inclined with respect to the reference direction D, the elements 9*a* of the first embodiment are engaged with each other to be inclined with respect to the reference direction as viewed in the width direction upon engaging thereof. Besides the element 9*a* of the first embodiment, any other elements in which at least one of first and second shoulder portions 94*a*, 94*b* and first and second groove portions 95*a*, 95*b* is inclined with respect to a reference direction D belong under the element, which is engaged to be inclined with respect to the reference direction D upon engaging thereof, and thus are referred to as an inclined engagement element in contrast with the parallel engagement element. Meanwhile, the plurality of elements 9 constituting the fastener chain 2 shown in FIGS. 7 and 8 comprises two different types of elements, i.e., the parallel engagement element 9*n* and the inclined engagement element 9*a*, and thus in some cases, the inclined engagement element is referred to as a first element and the parallel engagement element is referred to as a second element.

Like the first and second groove portions 95*a*, 95*b* of the parallel engagement element 9*n*, the first and second groove portions 95*a*, 95*b* of the inclined engagement element 9*a* are formed in a middle portion, in the upward and downward direction, of the engaging head portion 93 and thus are arranged at the same positions in the upward and downward direction, even if the inclined engagement element 9*a* is upside down. Also, in the shown example, the first and second groove portions 95*a*, 95*b* are communicated with each other to define one groove extending in a straight line shape along the length direction, and as viewed in the width direction, are formed to be parallel to the reference direction D. In addition, the first and second groove portions 95*a*, 95*b* communicated with each other in the length direction are formed to be opened toward the opposing tape 7 (in a direction along which they extends in parallel away from the core portion 7*a* in the width direction).

Because as viewed in the width direction, the first and second shoulder portions 94*a*, 94*b* have a shape symmetrical with respect to the neck portion 92 as the symmetry axis, detailed configurations of the first shoulder portion 94*a* will be mainly described and if necessary, the second shoulder portion 94*b* will be supplementarily described.

The first shoulder portion 94*a* is configured to protrude from middle portions, in the upward and downward direction, of both surfaces, in the length direction, of the neck portion 92. In more specifically explaining the protruding direction as viewed in the width direction, the protruding direction of the first shoulder portion 94*a* is inclined at a predetermined angle $\alpha$ with respect to the reference direction D. In the shown example, the first shoulder portion 94*a* is inclined to gradually extend downward as it goes away from the neck portion 92 in the length direction.

Figure 6:
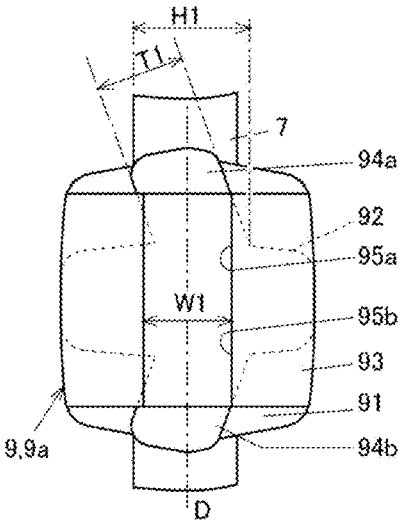
FIG. 6 is a view as viewed from a direction of an arrow VI in FIG. 3.

A thickness dimension T1 of the first shoulder portion 94*a* inclined as shown in FIG. 6 is a dimension as measured in a direction perpendicular to the protruding direction (inclining direction) of the first shoulder portion 94*a* itself as viewed in the width direction, and thus hereinafter is referred to as an "inclined shoulder-portion thickness dimension." The second groove portion 95*b*, shown, which is to be engaged with a first shoulder portion 94*a* of another element, not shown, is parallel to the reference direction D. Therefore, a groove width dimension W1 of the second groove portion 95*b* is a dimension as measured in the upward and downward direction, in other words, a dimension as measured in a direction perpendicular to the reference direction D, and thus hereinafter is referred to as a "parallel groove width dimension." Also, for the clearance allowing smooth engagement and disengagement, the inclined shoulder-portion Thickness dimension T1 is set to be smaller than the parallel groove width dimension W1. In addition, of dimensions of the first shoulder portion 94*a* inclined, a dimension H1 in the upward and downward direction (more specifically, as viewed in the width direction, a dimension as measured between a lower end of a distal portion of the first shoulder portion 94*a* and an upper end of a base end of the first shoulder portion 94*a* (the base end means an end of the first shoulder portion 94*a* located close to the neck portion 92)) is hereinafter referred to as an "inclined shoulder-portion height dimension." A relationship between the inclined shoulder-portion thickness dimension T1, the parallel groove width dimension W1 and the inclined shoulder-portion height dimension H1 is expressed by the inequality H1>W1>T1. More specifically, the inclined shoulder-portion height dimension H1 is 8% to 20% greater than the inclined shoulder-portion thickness dimension T1. Thus, if the inclined shoulder-portion thickness dimension T1 is 0.5 mm, the inclined shoulder-portion height dimension H1 is 0.54 mm to 0.6 mm. Also, a difference of the parallel groove width dimension W1 from the inclined shoulder-portion thickness dimension T1 is set to be greater than 0% and 2% or smaller. In addition, like the first shoulder portion 94*a* and the second groove portion 95*b*, the second shoulder portion 94*b* and the first groove portion 95*a* have also a relationship between an inclined shoulder-portion thickness dimension T1, a parallel groove width dimension W1 and an inclined shoulder-portion height dimension H1 as expressed by the inequality H1>W1>T1. Due to such relationships, the elements 9*a* of the first embodiment can be easily engaged with each other.

Also, as viewed in the upward and downward direction, a distal end of the first shoulder portion 94*a* (an end thereof away from the neck portion 92) in the length direction is positioned at a more front side in the length direction (front and rear direction) than the engaging head portion 93 and the body portion 91, and a side, which corresponds to the entire length in the length direction of the neck portion 92, of sides of the distal end of the first shoulder portion 94*a* is formed to be parallel to the width direction. Also, in addition to protruding from the neck portion 92, the first shoulder portion 94*a* is configured to protrude in the width direction from a surface of the body portion 91, which faces the opposing tape 7. Further, as viewed in the upward and downward direction, a side of a distal end of the first shoulder portion 94*a* in the width direction is formed to be parallel to the length direction. In addition, a corner portion between the side of the distal end of the first shoulder portion 94*a* in the length direction and the side of the distal end of the first shoulder portion 94*a* in the width direction is formed to be chamfered in a convexly rounded shape.

As shown in FIGS. 7 and 8, the fastener chain 2 according to the first embodiment of the present invention is configured so that a combination of the inclined engagement elements 9*a* of the first embodiment and the parallel engagement elements 9*n* is employed for a plurality of elements 9 constituting one fastener stringer 3 and the inclined engagement elements 9*a* of the first embodiment are employed for a plurality of elements 9 constituting the other fastener stringer 3, thereby providing engagement and disengagement between the inclined engagement elements 9*a* of the first embodiment and also between the inclined engagement elements 9*a* of the first embodiment and the parallel engagement element 9*n*. As in the first embodiment, elements 9 constituting the fastener chain of the present invention preferably comprise parallel engagement elements 9*n* and elements (inclined engagement elements) 9*a* of the present invention. In addition, the fastener chain of the present invention is configured to employ elements of the present invention so that the number thereof is two or more of the total number of the elements 9 (preferably, to employ two or more elements of the present invention and thus to engage the elements of the present invention with each other), thereby causing a form of the fastener chain in a closed state to become a form having a curved portion. Also, the fastener chain of the present invention does not exclude a fastener chain constituted of only inclined engagement elements 9*a*.

More specifically, one fastener stringer 3 (right side in FIG. 7) is configured so that on a part of the tape 7, one parallel engagement element 9*n* is fixed and a plurality of inclined engagement elements 9*a* of the first embodiment are fixed in each front and the rear of the parallel engagement element 9*n*, and also the inclined engagement elements 9*a* of the first embodiment in front of the parallel engagement element 9*n* and the inclined engagement elements 9*a* in the rear thereof are upside down to each other with respect to the tape 7.

Further, the other fastener stringer 3 (left side in FIG. 7) is configured so that in order to be engaged with the inclined engagement elements 9*a* and the parallel engagement elements 9*n* of the one fastener stringer 3, inclined engagement elements 9*a* in front of the parallel engagement element 9*n* of the one fastener stringer 3 (specifically, an inclined engagement element 9*a* to be engaged with a first shoulder portion 94*a* and a first groove portion 95*a* on the front side of the parallel engagement element 9*n* and inclined engagement elements 9*a* in front of the inclined engagement element 9*a*) and inclined engagement elements 9*a* in the rear of the parallel engagement element 9*n* (specifically, an inclined engagement element 9*a* to be engaged with a second shoulder portion 94*b* and a second groove portion 95*b* on the rear side of the parallel engagement element 9*n* and inclined engagement elements 9*a* in the rear of the inclined engagement element 9*a*) are upside down to each other with respect to the tape 7. Therefore, in each fastener stringer 3 of the example shown in FIG. 8, the first and second shoulder portions 94*a*, 94*b* of each of the inclined engagement elements 9*a* located in front of the parallel engagement element 9*n* are inclined to define a V-shape with respect to the neck portion 92, and the first and second shoulder portions 94*a*, 94*b* of each of the inclined engagement elements 9*a* located in the rear of the parallel engagement element 9*n* are inclined to define a reverse V-shape with respect to the neck portion 92.

Alternatively, the elements 9*a* of the first embodiment may be engaged with the parallel engagement elements 9*n*. But, the inclined engagement elements 9*a* of the first embodiment and the parallel engagement elements 9*n* have therebetween a relationship making engagement therebetween difficult as compared with the case where the inclined engagement elements 9*a* of the first embodiment are engaged with each other. The reason is that for example, on the front side of the neck portion 92 in the length direction (front and rear direction), as viewed in the width direction, the first shoulder portion 94*a* and the first groove portion 95*a* in the inclined engagement element 9*a* of the first embodiment intersect each other at a predetermined angle α, whereas the second shoulder portion 94*b* and the second groove portion 95*b* in the parallel engagement element 9*n* do not intersect each other, but extend parallel to the reference direction D. However, as described above, in the case where the parallel engagement elements 9*n*, 9*n* are engaged with each other, clearances (gaps) for allowing smooth engagement and disengagement are formed between the first shoulder portion 94*a* and the second groove portion 95*b* and also between the first groove portion 95*a* and the second shoulder portion 94*b*, which are engaged with each other. In the inclined engagement element 9*a* of the first embodiment, the first and second shoulder portions 94*a*, 94*b* are inclined at a predetermined angle α with respect to the reference direction D, but if the predetermined angle is a gentle angle (it is difficult to specify what degree the angle is), it is possible to engage the inclined engagement element 9*a* of the first embodiment with the parallel engagement element 9*n* using clearances therebetween. By the way, a thickness dimension (dimension in the upward and downward direction) of the first and second shoulder portions of the parallel engagement element 9*n* is the same as the inclined shoulder-portion thickness dimension T1 of the inclined engagement element 9*a*, and a groove width dimension (dimension in the upward and downward direction) of the first and second groove portions of the parallel engagement element 9*n* is the same as the parallel groove width dimension W1 of the inclined engagement element 9*a*.

If a slide fastener 1 including the fastener chain 2 of the first embodiment as described above is closed, the parallel engagement element 9*a* is engaged with the inclined engagement elements 9*a* of the first embodiment, respectively, on both sides thereof in the length direction, and also a part, in which the inclined engaging elements 9*a* of the first embodiment located in front of the parallel engagement element 9*n* are engaged with each other, and a part, in which the inclined engaging elements 9*a* of the first embodiment of the present invention located in the rear of the parallel engagement element 9*n* are engaged with each other, are obtained. In addition, curved shapes formed, respectively, as the inclined engaging elements 9*a* of the first embodiment located in front and the rear of the parallel engagement element 9*n* are engaged with each other are reversed to each other, so that the fastener chain 2 of the first embodiment is curved in an S-shape as a whole. Therefore, when the fastener chain 2 is closed, such curved shape can be actively formed.

Figure 9:
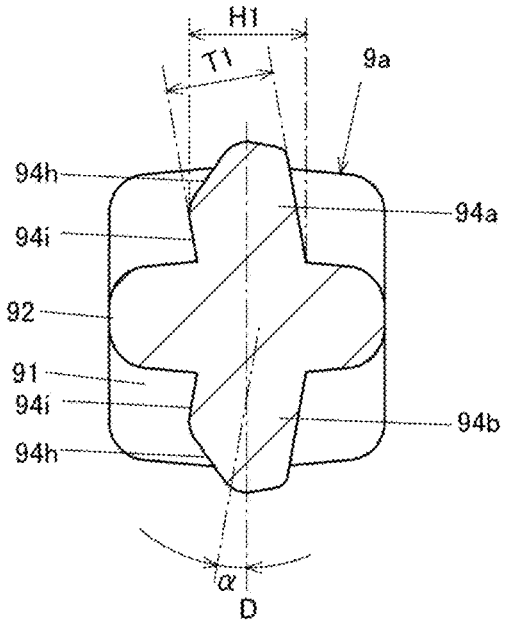
FIG. 9 is a sectional view taken along a line IX-IX in FIG. 10.
Figure 10:
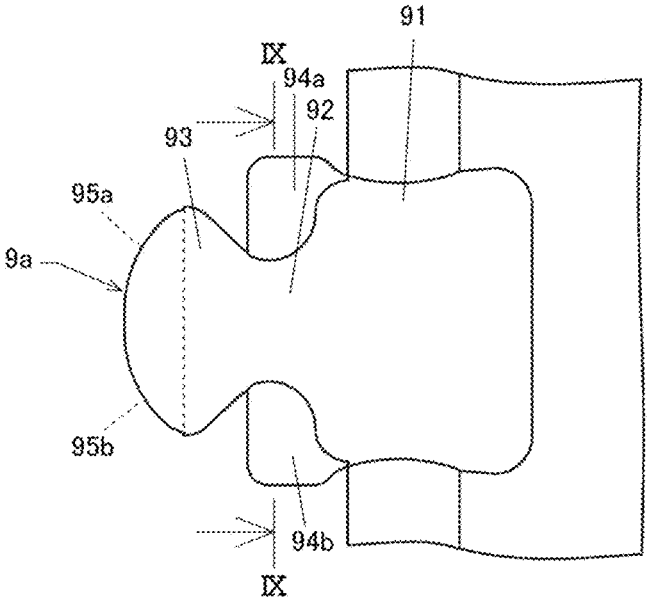
FIG. 10 is a plan view showing a variant of an element according to the first embodiment of the present invention.

A variant of the inclined engagement element 9*a* according to the first embodiment of the present invention is shown in FIGS. 9 to 10. The variant of the inclined engagement element 9*a* is characterized in that as viewed in the width direction, a distal portion of one of upper and lower surfaces of the first and second shoulder portions 94*a*, 94*b* is a distal-portion inclined surface 94*h* inclined so that a thickness thereof is gradually decreased as it goes toward a distal end thereof.

More specifically, as viewed in the width direction, for example, two upper and lower surfaces of the first shoulder portion 94*a* are exactly two surfaces oriented in a direction perpendicular to the protruding direction of the first shoulder portion 94*a* (two surfaces parallel to the protruding direction), and a distal portion of the lower surface of the two surfaces (upper and lower surfaces) is formed as the distal-portion inclined surface 94*h*. Therefore, the lower surface of each of the first and second shoulder portions 94*a*, 94*b* has an inclined surface 94*i* (inclined surface inclined at a predetermined angle α with the reference direction D) and the distal-portion inclined surface 94*h*.

Figure 11:
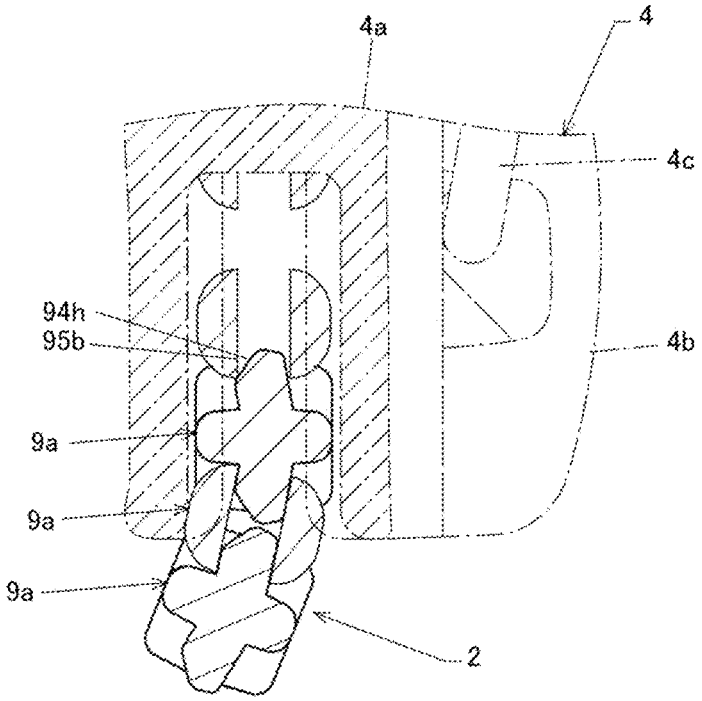
FIG. 11 is a sectional view showing a usage state of a variant of the fastener chain according to the first embodiment of the present invention.
Figure 12:
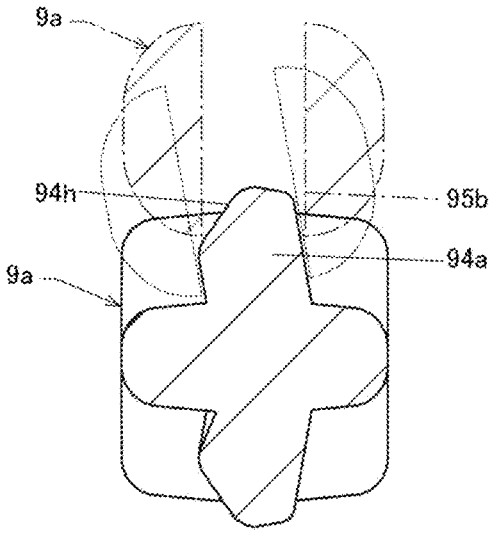
FIG. 12 is a sectional view showing movement of the variant of the element according to the first embodiment, upon engaging thereof.

A variant of the fastener chain 2 of the first embodiment employs as an element the variant of the inclined engagement element 9*a* of the first embodiment. Also, a slide fastener 1 including the variant of the fastener chain 2 of the first embodiment is shown in FIG. 11. If the slider 4 is moved forward to engage the variant of the fastener chain 2 and thus to close the fastener chain 2, as shown in FIGS. 11 and 12, in the inside of the slider body 4*a*, a first shoulder portion 94*a* of an inclined engagement element 9*a* on the rear side enters a second groove portion 95*b* of an inclined engagement element 9*a* on the front side, starting from a distal-portion inclined surface 94*h* thereof, and also a first shoulder portion 94*a* of an inclined engagement element 9*a* on the front side enters a first groove portion 95*a* of an inclined engagement element 9*a* on the rear side, starting from a distal-portion inclined surface 94*h* thereof, thereby facilitating engagement of the inclined engagement elements 9*a* with each other. Contrarily, if the slider 4 is moved rearward to disengage the variant of the fastener chain 2 and thus to open the fastener chain 2, the distal-portion inclined surface 94*h* facilitates also disengagement of the inclined engagement elements 9*a* from each other.

Figure 13:
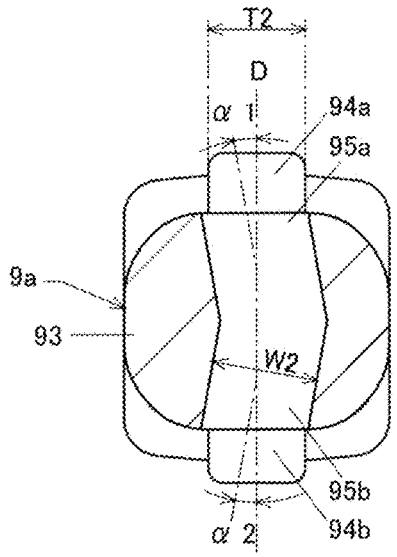
FIG. 13 is a sectional view taken along a line XIII-XIII in FIG. 14.
Figure 14:
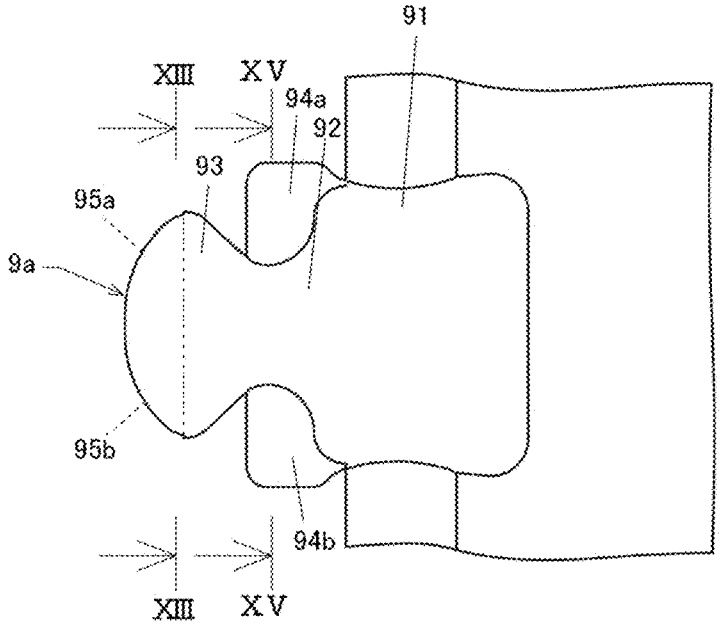
FIG. 14 is a plan view showing an element according to a second embodiment of the present invention.
Figure 15:
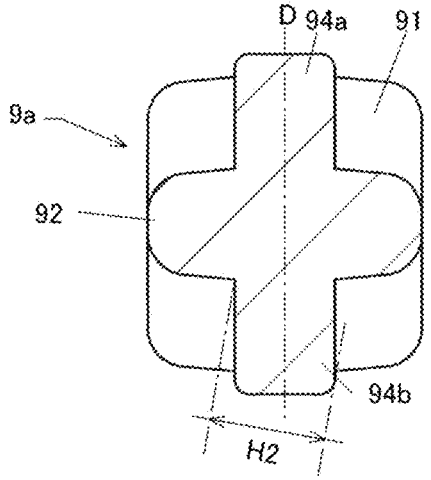
FIG. 15 is a sectional view taken along a line XV-XV in FIG. 14.
Figure 16:
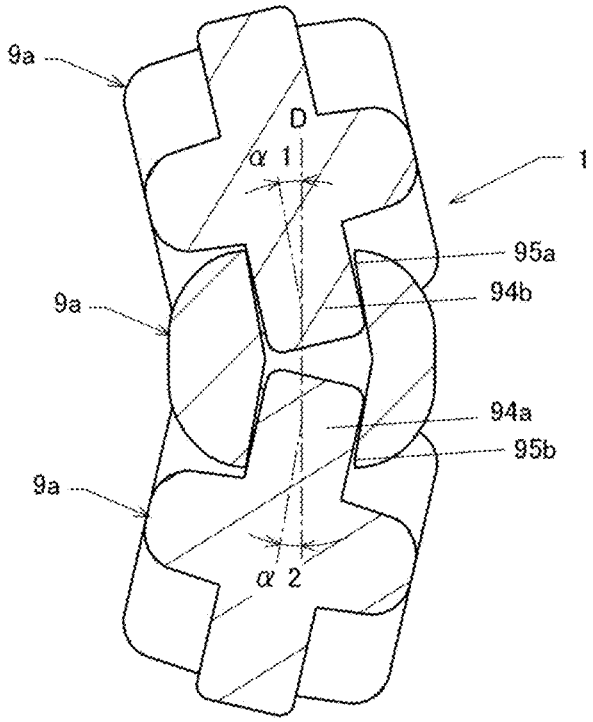
FIG. 16 is a sectional view showing a usage state of a fastener chain according to the second embodiment of the present invention.

Further, an inclined engagement element 9*a* according to a second embodiment of the present invention, as shown in FIGS. 13 to 15, is different from the inclined engagement element 9*a* according to the first embodiment, in that as viewed in the width direction, first and second groove portions 95*a*, 95*b* are inclined at a predetermined angle with a reference direction D and first and second shoulder portions 94*a*, 94*b* are parallel to the reference direction D. More specifically, the first and second groove portions 95*a*, 95*b* are inclined at different predetermined angles α1, α2 with respect to the reference direction D and are communicated with each other to be bent in a V-shape. A slide fastener 1 including a fastener chain 2 according to the second embodiment of the present invention, which employs the inclined engagement element 2*a* of the second embodiment, is shown in FIG. 16. If the fastener chain 2 of the second embodiment is closed, the fastener chain 2 has a curved shape, and with respect to one inclined engagement element 9*a*, inclined engagement elements 9*a* in front and the rear thereof are inclined at an angle obtained by summing the different predetermined angles α1, α2, at which the first and second groove portions 95*a*, 95*b* are respectively inclined with respect to the reference direction D. The different predetermined angles α1, α2 are set to be 10° or greater and 45° or smaller.

As shown in FIG. 13, of dimensions of the first shoulder portion 45, which is parallel to the reference direction D as viewed in the width direction, a dimension T2 as measured in the upward and downward direction (dimension perpendicular to the reference direction D) is hereinafter referred to as "parallel shoulder-portion thickness dimension." Also, the second groove portion 95*b*, shown, which is to be engaged with a first shoulder portion 94*a* of another element, not shown, is inclined with respect to the reference direction D, and of dimensions of the second groove portion 95*b*, a dimension W2 as measured in a direction perpendicular to the inclining direction thereof is referred to as an inclined groove width dimension. In addition, for a clearance allowing smooth engagement and disengagement, the parallel shoulder-portion thickness dimension T2 is set to be smaller than the inclined groove width dimension W2. Further, as shown in FIG. 15, of dimensions of the first shoulder portion 45, which is parallel to the reference direction D, a dimension H2 as measured in the direction perpendicular to the inclining direction of the second groove portion 95*b* is referred to as a second parallel shoulder-portion thickness dimension. More specifically, the second parallel shoulder-portion thickness dimension is a dimension which is measured between two parallel lines in a direction perpendicular thereto when the two lines are separately drawn from different two points on the first shoulder portion 94*a* to be parallel to the inclining direction of the second groove portion as viewed in the width direction. By the way, one parallel line is drawn through a lower end of a base end of the first shoulder portion 94*a* (the base end means an end of the first shoulder portion 94*a* close to the neck portion 92), and the other parallel line is drawn from a distal portion (corner portion) of an upper end of the first shoulder portion 94*a* to be tangent thereto. Also, a relationship between the second parallel shoulder-portion thickness dimension H2, the inclined groove width dimension W2 and the parallel shoulder-portion thickness dimension T2 is expressed by the inequality H2>W2>T2. More specifically, a difference of the inclined groove width dimension W2 from the parallel shoulder-portion thickness dimension T2 is set to be greater than 0% and 2% or smaller. In addition, the second shoulder portion 94*b* and the first groove portion 95*a* have the same parallel shoulder-portion thickness dimension T2 and inclined groove width dimension W2 as those of the first shoulder portion 94*a* and the second groove portion 95*b*. Accordingly, like the first shoulder portion 94*a* and the second groove portion 95*b*, the second shoulder portion 94*b* and the first groove portion 95*a* have also a relationship between a parallel shoulder-portion thickness dimension T2, an inclined groove width dimension W2 and a second parallel shoulder-portion thickness dimension H2 as expressed by the inequality H2>W2>T2. Due to such relationships, the elements 9*a* of the second embodiment can be easily engaged with each other.

Figure 17:
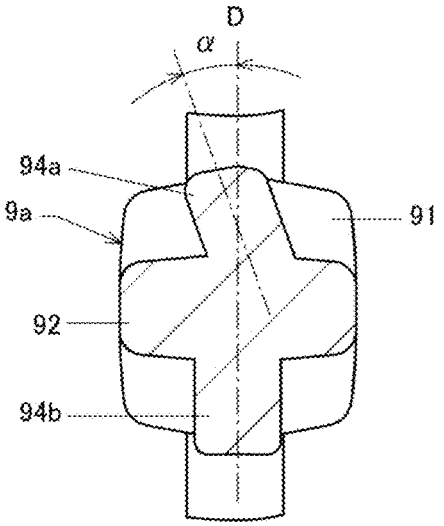
FIG. 17 is a sectional view showing an element according to a third embodiment of the present invention.

An inclined engagement element 9*a* according to a third embodiment of the present invention, as shown in FIG. 17, is different from the inclined engagement element 9*a* according to the first embodiment, in that as viewed in the width direction, one of first and second shoulder portions 94*a*, 94*b* (first shoulder portion 94*a* in the figure) is inclined with respect to a reference direction D, the other (second shoulder portion 94*b* in the figure) is parallel to the reference direction D and also first and second groove portions (not shown) are parallel to the reference direction D.

Figure 18:
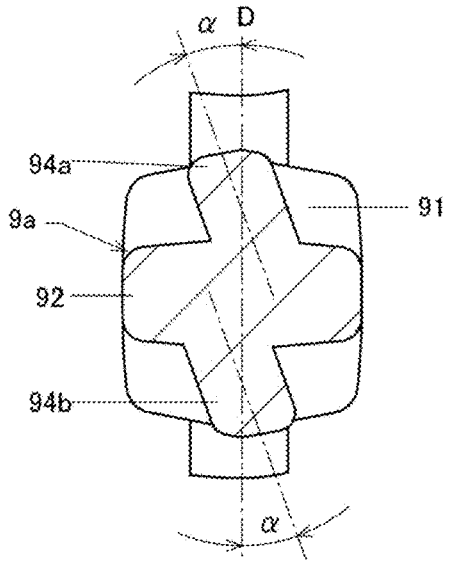
FIG. 18 is a sectional view showing an element according to a fourth embodiment of the present invention.

An inclined engagement element 9*a* according to a fourth embodiment of the present invention, as shown in FIG. 18, is different from the inclined engagement element 9*a* according to the first embodiment, in that as viewed in the width direction, first and second shoulder portions 94*a*, 94*b* are inclined with respect to a reference direction D, but protrude in directions opposing each other, and also first and second groove portions (not shown) are parallel to the reference direction D.

More specifically, as viewed in the width direction, the first and second shoulder portions 94*a*, 94*b* have a so-called point symmetric relationship therebetween. Namely, the center of the neck portion 92 in the upward and downward direction is the center of point symmetry, and a form of the first shoulder portion 94*a* when being rotated by 180° about the center is a form of the second shoulder portion 94*b*.

Figure 19:
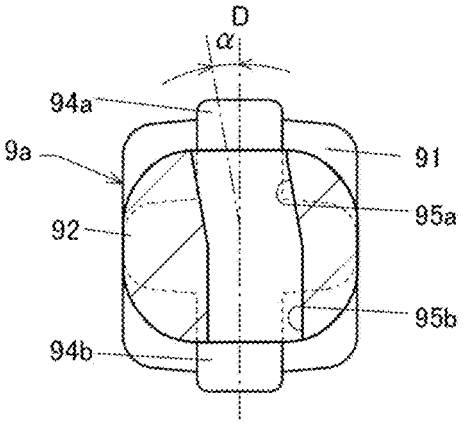
FIG. 19 is a sectional view showing an element according to a fifth embodiment of the present invention.

An inclined engagement element 9*a* according to a fifth embodiment of the present invention, as shown in FIG. 19, is different from the inclined engagement element 9*a* according to the first embodiment, in that as viewed in the width direction, one of first and second groove portions 95*a*, 95*b* (first groove portion 95*a* in the figure) is inclined with respect to a reference direction D, the other (second groove portion 95*b* in the figure) is parallel to the reference direction D and also first and second shoulder portions 94*a*, 94*b* are parallel to the reference direction D.

The present invention is not limited to the foregoing embodiments and accordingly appropriate modifications thereof may be made without departing from the spirit and scope of the invention. Although in the foregoing embodiments, as viewed in the width direction, one side of the first and second shoulder portions 94*a*, 94*b* and the first and second groove portions 95*a*, 95*b* is inclined with respect to the reference direction D and the other side is parallel to the reference direction D, the element of the present is not necessarily limited to such a relationship and accordingly may have a relationship that both are inclined. Also, although in the foregoing embodiments, the first groove portion 95*a* and the second groove portion 95*b* are communicated with each other to define one groove extending in a straight line shape or bent in a V-shape, the element of the present invention is not limited to such configurations, and accordingly, if not shown, the first groove portion and the second groove portion may be respectively formed by two separate grooves, which are not communicated with each other (more specifically, the first groove portion and the second groove portion may be formed to be partitioned by the center, in the length direction, of the engaging head portion).

Further, although in the foregoing embodiments, the element row 8 of one of the pair of fastener stringers 3, 3 is constituted of elements 9*a* according to one embodiment of the present invention (inclined engagement elements=first elements) and parallel engagement elements 9*n* (second elements) and the other element row 8 is constituted of parallel engagement elements 9*n*, the fastener chain of the present invention is not limited to such a configuration, and accordingly, each element row 8 may be constituted of inclined engagement elements 9*a* and parallel engagement elements 9*n*.

DESCRIPTION OF REFERENCE NUMERALS

1 Slide Fastener
2 Fastener Chain
3 Fastener Stringer
4 Slider
4*a* Slider Body
4*b* Pull Tab Attachment Portion
4*c* Pull Tab
5 Stop
6 Stop
6*a* Separable Pin
6*b* Retainer
6*c* Retainer Pin
6*d* Retainer Body
7 Tape
7*a* Core Portion
8 Element Row
9 Element
9*a* Inclined Engagement Element (First Element)
9*n* Parallel Engagement Element (Second Element)
91 Body Portion
92 Neck Portion
93 Engaging Head Portion
94*a* First Shoulder Portion

94*b* Second Shoulder Portion
94*h* Distal-Portion Inclined Surface
94*i* Inclined Surface
95*a* First Groove Portion
95*b* Second Groove Portion
W1 Parallel Groove Width Dimension
W2 Inclined Groove Width Dimension
T1 Inclined Shoulder-Portion Thickness Dimension
T2 Parallel Shoulder-Portion Thickness Dimension
H1 Inclined Shoulder-Portion Height Dimension
H2 Second Parallel Shoulder-Portion Thickness Dimension
C Clothes
D Reference Direction
$\alpha$, $\alpha$1, $\alpha$2 Predetermined angle

The invention claimed is:

1. A fastener chain including an element, the element comprising a body portion fixed on a core portion of a tape extending in a length direction and a width direction, the core portion extending in the length direction on one side edge portion of the tape; a neck portion protruding from the body portion to extend away from the tape in the width direction; a pair of shoulder portions protruding from a front surface and a rear surface of the neck portion in the length direction when considered from an upper side of the element; an engaging head portion protruding from the neck portion to extend away from the tape in the width direction; and a pair of groove portions formed in the engaging head portion, each of the groove portions extending in the length direction when considered from the upper side of the element, wherein as viewed in the width direction, the element has at least one of a protruding direction of the pair of shoulder portions inclined with respect to a reference direction and an extending direction of the pair of groove portions inclined with respect to the reference direction, wherein the reference direction is an extending direction of the core portion on which the body portion is fixed such that the fastener chain forms a curved shape when closed.

2. The fastener chain according to claim 1, wherein the fastener chain includes a plurality of fastener elements and the plurality of the fastener elements includes three or less of the elements, and a remainder of the plurality of the fastener elements each have a body portion, a neck portion, a pair of shoulder portions and a pair of groove portions, wherein the pair of shoulder portions and the pair of groove portions thereof are parallel to the reference direction when viewed in the width direction.

3. The fastener chain according to claim 2, wherein as viewed in the width direction, the three or less of the elements have the pair of groove portions parallel to the reference direction and the pair of shoulder portions inclined with respect to the reference direction.

4. The fastener chain according to claim 3, wherein as viewed in the width direction, the three or less of the elements each have the pair of groove portions, each having a parallel groove width dimension, as measured in a direction perpendicular to the reference direction, and the pair of shoulder portions, each having an inclined shoulder-portion thickness dimension, as measured in a direction perpendicular to an inclining direction, and each having an inclined shoulder-portion height dimension, as measured in a direction perpendicular to the reference direction, that satisfy the following relationship:

the inclined shoulder-portion height dimension>the parallel groove width dimension>the inclined shoulder-portion thickness dimension.

5. The fastener chain according to claim 3, wherein as viewed in the width direction, the pair of shoulder portions of the three or less of the elements are inclined to be symmetrical with respect to the neck portion as a symmetry axis.

6. The fastener chain according to claim 2, wherein as viewed in the width direction, the three or less of the elements have the pair of shoulder portions parallel to the reference direction and the pair of groove portions inclined with respect to the reference direction.

7. The fastener chain according to claim 6, wherein as viewed in the width direction, the three or less of the elements each have the pair of groove portions, each having an inclined groove width dimension, as measured in a direction perpendicular to an inclining direction, and the pair of shoulder portions, each having a parallel shoulder-portion thickness dimension, as measured in a direction perpendicular to the reference direction, and each having a second parallel shoulder-portion thickness dimension, as measured in a direction perpendicular to the inclining direction of each of the groove portions that satisfy the following relationship:

the second parallel shoulder-portion thickness dimension>the inclined groove width dimension>the parallel shoulder-portion thickness dimension.

8. The fastener chain according to claim 1, further comprising a second tape, wherein the tape and the second tape form a pair of tapes, the pair of tapes extending parallel to each other in the length direction, wherein the pair of tapes are arranged to oppose each other in the width direction; and a pair of fastener element rows are fixed on the core portions of the pair of tapes, the core portions being, respectively, opposing side edge portions of the pair of tapes, wherein the pair of fastener element rows comprises a plurality of fastener elements fixed on each of the tapes along the length direction and the plurality of fastener elements includes at least two of the elements, and wherein the at least two of the elements are arranged to be engaged with each other.

9. The fastener chain according to claim 8, wherein each of the fastener element rows comprises a plurality of second elements, and wherein the second elements are different from the element and each of the second elements comprises a body portion, a neck portion, a pair of shoulder portions and a pair of groove portions, wherein each of the second elements is configured so that as viewed in the width direction, the pair of shoulder portions and the pair of groove portions thereof are parallel to the reference direction.

10. A fastener chain including an element, the element comprising a body portion fixed on a core portion of a tape extending in a length direction and a width direction, the core portion extending in the length direction on one side edge portion of the tape; a neck portion protruding from the body portion to extend away from the tape in the width direction; a pair of shoulder portions protruding from a front surface and a rear surface of the neck portion in the length direction when considered from an upper side of the element; an engaging head portion protruding from the neck portion to extend away from the tape in the width direction; and a pair of groove portions formed in the engaging head portion, each of the groove portions extending in the length direction when viewed from the upper side of the element, wherein as viewed in the width direction, an extending direction of the pair of groove portions of the element is parallel to a reference direction and a protruding direction of the pair of shoulder portions is inclined with respect to the reference direction, wherein the reference direction is an extending direction of the core portion on which the body portion is fixed such that the fastener chain forms a curved shape when closed, wherein as viewed in the width direction, the pair of groove portions, each having a parallel groove width dimension, as measured in a direction perpendicular to the reference direction, and the pair of shoulder portions, each having an inclined shoulder-portion thickness dimension, as measured in a direction perpendicular to an inclining direction, and each having an inclined shoulder-portion height dimension, as measured in the direction perpendicular to the reference direction, that satisfy the following relationship:

the inclined shoulder-portion height dimension>the parallel groove width dimension>the inclined shoulder-portion thickness dimension.

11. A fastener chain including an element, the element comprising a body portion fixed on a core portion of a tape extending in a length direction and a width direction, the core portion extending in the length direction on one side edge portion of the tape; a neck portion protruding from the body portion to extend away from the tape in the width direction; a pair of shoulder portions protruding from a front surface and a rear surface of the neck portion in the length direction when considered from an upper side of the element; an engaging head portion protruding from the neck portion to extend away from the tape in the width direction; and a pair of groove portions formed in the engaging head portion, each of the groove portions extending in the length direction when considered from the upper side of the element, wherein as viewed in the width direction, the element has a protruding direction of the pair of shoulder portions parallel to a reference direction and an extending direction of the pair of groove portions inclined with respect to the reference direction, wherein the reference direction is an extending direction of the core portion on which the body portion is fixed such that the fastener chain forms a curved shape when closed.

* * * * *